US012042711B2

(12) United States Patent
Han

(10) Patent No.: US 12,042,711 B2
(45) Date of Patent: Jul. 23, 2024

(54) GOLF SWING TRAINING DEVICE

(71) Applicant: David Han, Yorktown, VA (US)

(72) Inventor: David Han, Yorktown, VA (US)

( * ) Notice: Subject to any disclaimer, the term of this patent is extended or adjusted under 35 U.S.C. 154(b) by 0 days.

(21) Appl. No.: 17/662,048

(22) Filed: May 4, 2022

(65) Prior Publication Data

US 2023/0356055 A1 Nov. 9, 2023

(51) Int. Cl.
*A63B 69/36* (2006.01)

(52) U.S. Cl.
CPC ..... *A63B 69/3608* (2013.01)

(58) Field of Classification Search
CPC ..... A63B 69/3608; A63B 2071/0655; A63B 2225/09; A63B 69/0059
USPC ..... 473/207–211, 247, 252, 266, 268, 278, 473/280
See application file for complete search history.

(56) References Cited

U.S. PATENT DOCUMENTS 2,643,382 A 6/1953 McLeod
3,228,696 A * 1/1966 Hull ..... G02C 5/003 351/110
3,555,563 A * 1/1971 Grossman ..... G02C 7/16 351/85
3,729,199 A * 4/1973 Granberg ..... A63B 69/3608 351/158
D246,529 S 11/1977 Thomas
4,129,362 A * 12/1978 Lorenzo ..... G02C 3/003 351/123
4,133,604 A * 1/1979 Fuller ..... G02C 3/003 351/123
D256,025 S 7/1980 Lewis
4,251,076 A 2/1981 Krupicka
4,298,201 A 11/1981 Palinkas
(Continued)

FOREIGN PATENT DOCUMENTS

GB 2125298 A * 3/1984 ..... A63B 69/3608

OTHER PUBLICATIONS

Bone Conduction Headphones. (Sep. 14, 2023). Site visited Feb. 6, 2024. [https://www.amazon.com/u Conduction-Headphones-Bluetooth-Waterproof-Certified/dp/B0CJ2Q6Q3P/ref=sr 1_ 17?crid= 1 BZTCUTQSJY0P&keywords=neckband+vision+focus&qid=1707241696&sprefix=neckband+vision+focus%2Caps%2C77&sr=8-17-spons&sp_csd=d2lkZ2V0Tm FtZT1 zcF9idGY&psc=1].
(Continued)

*Primary Examiner* — Nini F Legesse
(74) *Attorney, Agent, or Firm* — INNOVATION CAPITAL LAW GROUP, LLP; Vic Lin

(57) ABSTRACT

A golf swing training device can be easily worn by a user, without requiring any special connection mechanism or clothing item, to provide adjustably positionable sights that assist users in improving their golf swing. One goal of the training device is to keep the golfer's vision focused on the ball while taking the swing and minimize head movement, especially during the backswing. When the correct focus is established, the swing will follow, therefore enhancing muscle memory to improve the user's swing consistency. A pair of focusing rings may be flexibly connected to a mounting system. The focusing rings can be positioned to help the golfer focus on the ball while taking their swing, especially while putting. The mounting system can secure the focusing rings in the desired position during use, while being comfortable to wear.

19 Claims, 9 Drawing Sheets

(56) References Cited

U.S. PATENT DOCUMENTS

| | | | | |
|---|---|---|---|---|
| D274,918 | S | 7/1984 | Trice, Jr. et al. | |
| 4,473,370 | A | 9/1984 | Weiss | |
| 4,541,696 | A * | 9/1985 | Winger | G02C 3/003 351/123 |
| D292,411 | S | 10/1987 | Baptiste | |
| D304,950 | S | 12/1989 | Guillet | |
| 4,896,375 | A | 1/1990 | Colucci | |
| 5,171,152 | A * | 12/1992 | McCleery | A63B 69/3608 2/209.13 |
| 5,183,059 | A | 2/1993 | Leonardi | |
| 5,191,363 | A * | 3/1993 | Smith | A61F 9/026 351/62 |
| D385,357 | S | 10/1997 | Alworth | |
| D385,387 | S | 10/1997 | Berke | |
| D385,388 | S | 10/1997 | Berke et al. | |
| D421,040 | S | 2/2000 | Berke | |
| D432,556 | S | 10/2000 | Lando | |
| D441,388 | S | 5/2001 | Lightman | |
| 6,224,492 | B1 * | 5/2001 | Grimes | A63B 69/3667 473/268 |
| D457,547 | S | 5/2002 | Chiang | |
| 6,390,823 | B1 * | 5/2002 | Wesenhagen | A63B 69/3608 434/252 |
| D458,245 | S | 6/2002 | Masuda | |
| 6,690,808 | B2 * | 2/2004 | Urwyler | H04R 1/1033 381/381 |
| 6,761,450 | B1 | 7/2004 | Baum et al. | |
| D525,614 | S | 7/2006 | Lee | |
| D588,184 | S | 3/2009 | Lane et al. | |
| D625,349 | S | 10/2010 | Aryan et al. | |
| D640,666 | S | 6/2011 | Wahl | |
| 8,157,663 | B1 * | 4/2012 | Winkelsas | G02C 7/16 351/158 |
| D688,287 | S | 8/2013 | Huschka | |
| D688,727 | S | 8/2013 | Olsson | |
| D697,962 | S | 1/2014 | Olsson | |
| D702,662 | S | 4/2014 | Vrotsos et al. | |
| D705,322 | S | 5/2014 | Huschka | |
| D705,323 | S | 5/2014 | Huschka | |
| D709,673 | S | 7/2014 | Aimone et al. | |
| D710,325 | S | 8/2014 | Behar et al. | |
| D717,765 | S | 11/2014 | Rausch et al. | |
| D717,796 | S | 11/2014 | Olsson | |
| 8,944,931 | B2 | 2/2015 | Nell et al. | |
| D723,698 | S | 3/2015 | Cockley | |
| D726,721 | S | 4/2015 | Olsson | |
| 9,039,168 | B1 * | 5/2015 | Lando | G02C 3/006 351/124 |
| D739,122 | S | 9/2015 | Aimone et al. | |
| D781,369 | S | 3/2017 | Siler, Jr. | |
| 9,753,312 | B2 | 9/2017 | Moore | |
| 9,789,378 | B1 | 10/2017 | Threlkeld et al. | |
| D804,151 | S | 12/2017 | Aimone et al. | |
| D867,437 | S | 11/2019 | Lian | |
| D901,016 | S | 11/2020 | Park et al. | |
| D907,778 | S | 1/2021 | Ekonomi | |
| 11,305,118 | B2 | 4/2022 | Rockley et al. | |
| D970,599 | S | 11/2022 | Douglass et al. | |
| 2004/0120035 | A1 | 6/2004 | Hoffmann | |
| 2005/0280773 | A1 * | 12/2005 | Bent | A61F 9/027 351/158 |
| 2009/0105006 | A1 | 4/2009 | Doyle | |
| 2014/0162799 | A1 * | 6/2014 | Hocknull | A63B 69/3608 473/210 |
| 2014/0198017 | A1 | 7/2014 | Lamb et al. | |
| 2016/0139434 | A1 | 5/2016 | Moore | |
| 2016/0334644 | A1 | 11/2016 | Garofolo et al. | |
| 2016/0349534 | A1 * | 12/2016 | Lando | G02C 3/003 |
| 2017/0249863 | A1 | 8/2017 | Murgia et al. | |
| 2021/0191151 | A1 * | 6/2021 | Perry, II | G02C 5/14 |
| 2021/0349322 | A1 | 11/2021 | Harris et al. | |
| 2022/0078537 | A1 | 3/2022 | Meyberg Guzman et al. | |

OTHER PUBLICATIONS

Watch Repair Glasses. (Jul. 18, 2014). Site visited Feb. 6, 2024. [https://www.amazon.com/dp/BOOLXOR220/ref=sspa_dk_detail_4 ?psc= 1 & pf_rd_p=eb 7c1 ac5-7c51-4df5-ba34-ca81 0f1 f119a &pf_rd_r= RCG5ZRH9GZHY JPR0SQTT&pd_rd_wg=VWZ4V &pd_rd_w=Sji2H& content-[item V contd] id=amzn1.sym.eb7c1ac5-7c51-4df5-ba34-ca810f1f119a&pd_rd_r=3c020e73-7ecc-41b2-be7b-6eb82a89d4ef&s=kitchen&sp_csd= d2lkZ2V0TmFtZT1zcF9kZXRhaWw].

Dilzekui. (Dec. 3, 2021). Site visited Feb. 6, 2024. [https://www.amazon.com/dp/B09DD79KN N/ref=sspa_dk_detail_3?pd_rd_i= B09DD79KN N &pd_rd_w=y5T g N &content-id=amzn 1.sym. 386c27 4b-4bfe-4421-9052-a 1 a56db557ab&pf_rd_p=386c27 4b-4bfe-4421-9052-a1a56db557 ab&pf_rd_r=6 M9465 BW3 KVY J5330 H0J&pd_rd_wg=6CXwO&pd_rd_r= 71296bb5-552e-4144-b8e 7 -68d3abc5d021 &s=kitchen&sp_csd=d2lkZ2V0Tm FtZT1zcF9kZXRhaWxfdGhlbWF0aWM&th= 1].

Monocle Clip-On. Feb. 10, 2023. Site visited Feb. 6, 2024. [https://www.designboom.com/technology/monocle-world-smallest-ar-device-cli p-glasses-bril liant-labs-2-10-2023/] (Year: 2023).

Dilzekui Magnifying Glasses. Jun. 20, 2023. Site visited Feb. 6, 2024. [https://www.amazon.com/dp/BOC8M4B2L T?ref=emc_s_m_5_i_n&th=1] (Year: 2023).

Shokz. Sep. 1, 2021. Site visited Feb. 6, 2024. [https://www.amazon.com/Shokz-OpenRun-Pro-Conduction-Built/dp/B09BVXT8T J/ref= sr_ 1 2?keywords=AS600+trekz+ Titanium+ Bone+Conduction+ Bluetooth+ Headset+Sports+Wireless+ Non-ear+Bone+Sensing+ Hanging+ Ear&qid= 1707241567&sr=8-2-pons&sp_csd= d2lkZ2V0Tm FtZT1zcF9hdGY&psc= 1] (Year: 2021).

Magnifier Loupe. Apr. 21, 2023. Site visited Feb. 6, 2024. [https://www.amazon.com/u Magnifier-Watchmakers-Jewellers-Eyeglass-Accessories/dp/B0C36VHX9N/ref=sr_ 1_55?crid=2KZ6ZZXXFED6Q &keywords=headband+ monocle&qid=1707235456&sprefix= headband+ monocle%2Caps%2C 188&sr=8-55-spons&spcsd= d2lkZ2V0TmFtZT1zcF9tdGY&psc=1] (Year: 2023).

* cited by examiner

GOLF SWING TRAINING DEVICE

BACKGROUND OF THE INVENTION

1. Field of the Invention

Embodiments of the invention relate generally to golf training devices. More particularly, embodiments of the invention relate to a golf swing training device that helps focus the golfer's attention to perform a proper golf swing.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

When swinging at a golf ball, the golfer needs to keep their head still while focusing on their visualization of the ball while the club makes contact with the ball. Golfers can spend countless dollars on training and various conventional devices to help improve their swing. For example, conventional approaches to help focus the golfer's attention include laser lights mounted on the golfer, such as on their hats, to help focus the golfer's attention in a proper direction during their swing. Such devices, however, can require proper support for set up, such as a hat, and can be limited in effectiveness in bright, sunny locations.

In view of the foregoing, there is a need for device to improve a golf swing of a user.

SUMMARY OF THE INVENTION

Embodiments of the present invention provide a golf swing training device comprising a rear connector operable to resiliently expand to extend partially about a user's head from behind one ear to behind an opposite ear, the resilient expansion providing a pressure drawing a first end of the rear connector toward a second, opposite end of the rear connector; first and second ear mounts disposed on each of the first end and the second end of the rear connector, the first and second ear mounts each having an upper portion shaped to be disposed around an upper portion of a user's ear; an arm extending from one of the first and second ear mounts; and a focusing ring disposed at end of the arm.

In some embodiments, the rear connector is formed in a C-shape.

In some embodiments, first and second rear ear pads are respectively disposed at the first end and the second, opposite end of the rear connector. The first and second rear ear pads can have a planar contact surface operable to press against the user's head when the golf swing training device is disposed on a user. The upper portion of the first and second ear mounts can extend from a top side of respective first and second rear ear pads and terminate at a top side of first and second front ear pads. The first and second front ear pads can have a planar contact surface operable to press against the user's head when the golf swing training device is disposed on a user. The arm can extend from a side of one of the first and second front ear pads. In some embodiments, the arm is removably attached to side of one of the first and second front ear pads. In some embodiments, the first and second front ear pads are disposed along a plane higher than a plane defined by the first and second rear ear pads, higher being defined as closer to a top of the user's head when the golf swing training device is worn by a user.

In some embodiments, the first and second ear mounts include respective first and second lower arc shapes configured to extend about a lower portion of the user's ears when the golf swing training device is worn by a user. The arm can extend from a front portion of an end of one of the first and second lower arc shapes. In some embodiments, the arm is removably attached to the front portion of the end of one of the first and second lower arc shapes. In some embodiments, the upper portion of the first and second ear mounts form a continuous C-shape with the first and second lower arc shapes, where ends of the C-shape can point toward each other.

In some embodiments, the arm is at least partially bendable along one or more portions thereof to permit a user to bend the arm and the arm retains the bend selected by the user.

In some embodiments, the rear connector and the first and second ear mounts provide at least three points of contact with a user when the golf swing training device is worn by the user.

Embodiments of the present invention further provide a golf swing training device comprising a rear connector operable to resiliently expand to extend partially about a user's head from behind one ear to behind an opposite ear, the resilient expansion providing a pressure drawing a first end of the rear connector toward a second, opposite end of the rear connector; first and second rear ear pads respectively disposed at the first end and the second, opposite end of the rear connector; first and second upper portions extending from a side edge of respective first and second rear ear pads, the first and second upper portions being shaped to be disposed around an upper portion of a user's ear; first and second front ear pads disposed at ends of respective first and second upper portions; an arm extending from a front edge of one of the first and second front ear pads, the arm being at least partially bendable along one or more portions thereof to permit a user to bend the arm and the arm retains the bend selected by the user; and a focusing ring disposed at an end of the arm, wherein the first and second rear ear pads have a planar contact surface operable to press against the user's head when the golf swing training device is disposed on a user; the first and second front ear pads have a planar contact surface operable to press against the user's head when the golf swing training device is disposed on a user; and the rear connector and the first and second front and rear ear mounts provide at least three points of contact with a user when the golf swing training device is worn by a user.

Embodiments of the present invention also provide a golf swing training device comprising a rear connector operable to resiliently expand to extend partially about a user's head from behind one ear to behind an opposite ear, the resilient expansion providing a pressure drawing a first end of the rear connector toward a second, opposite end of the rear connector; first and second lower arc shapes configured to extend about a lower portion of the user's ears when the golf swing training device is worn by a user, a back side of the first and second lower arc shapes attached to respective first and second, opposite ends of the rear connector; an arm extending from a front edge of respective first and second lower arc shapes, the arm being at least partially bendable along one or more portions thereof to permit a user to bend the arm and the arm retains the bend selected by the user; first and second upper arc shapes forming a continuous C-shape with respective first and second lower arc shapes, the first and second upper arc shapes configured to be disposed about an upper portion of a user's ear when the golf swing training device is disposed on a user; a focusing ring disposed at an end of the arm, wherein the rear connector and the first and second front and rear ear mounts provide at least three points of contact with a user when the golf swing training device is worn by a user; and ends of the C-shape point toward each other.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
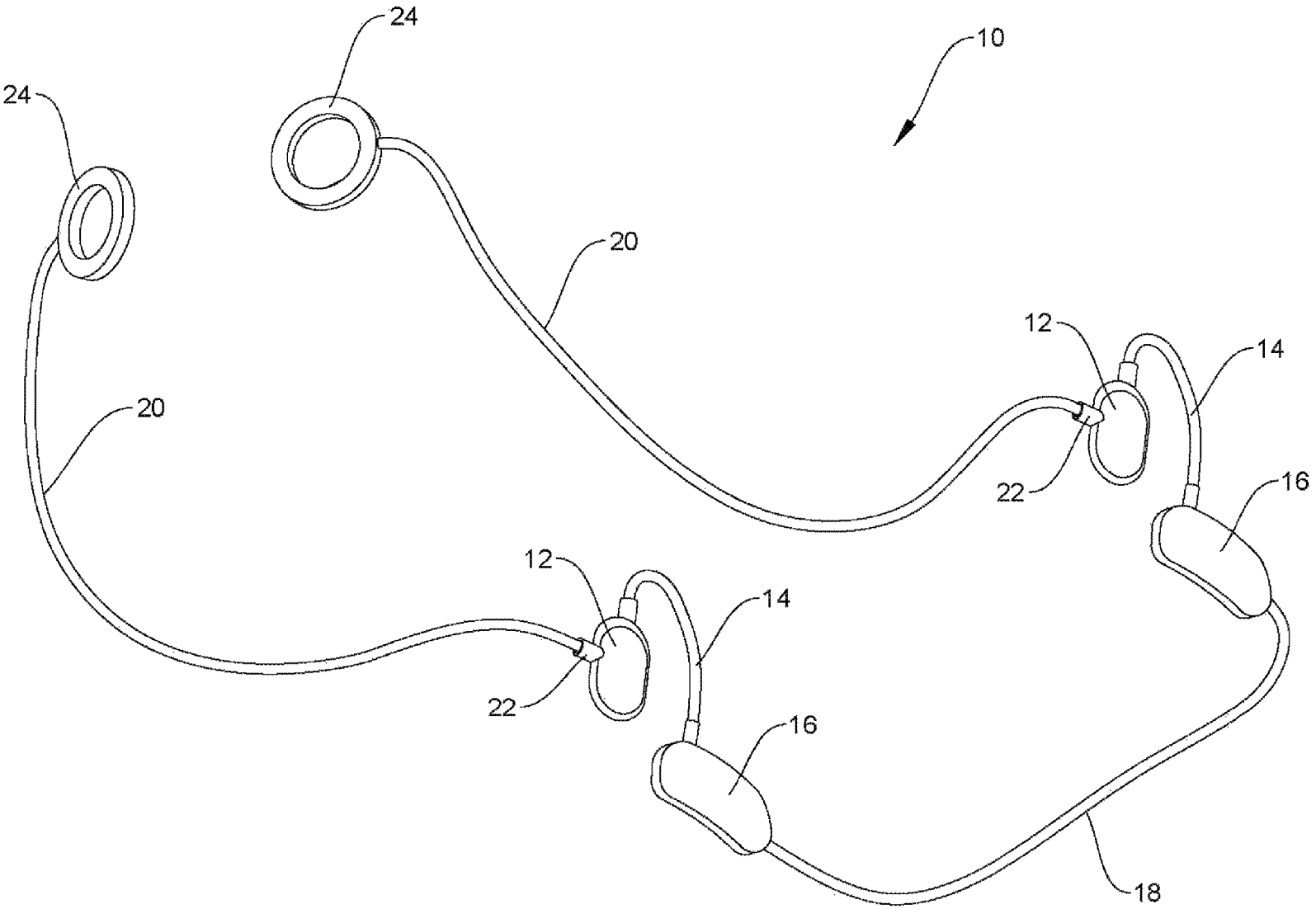
FIG. 1 illustrates a perspective view of a golf swing training device according to an exemplary embodiment of the present invention.

Unless otherwise indicated illustrations in the figures are not necessarily drawn to scale. The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a golf swing training device that can be easily worn by a user, without requiring any special connection mechanism or clothing item. The golf swing training device provides adjustably positionable sights that can use the foveal field of vision to assist users while practicing golf swings. One goal is to keep the golfer's vision focused on the ball while taking the swing. When the correct focus is established, the swing will follow, therefore enhancing muscle memory to improve the user's swing consistency. A pair of focusing rings may be flexibly connected to a mounting system. The focusing rings can be positioned to help the golfer focus on the ball while taking their swing. The mounting system can secure the focusing rings in the desired position during use, while being comfortable to wear.

As discussed in greater detail below, the device can use a minimum of three points of contact on the user's head to connect each of the focusing rings to the user's head. The device may be placed with these multiple anchor points along the three axes of the movement of the head to reduce aim point movement. The device can be set up quickly and easily positioned to place the focusing rings in the proper location for helping the user focus on the ball during their swing. The device can be made lightweight, making the device comfortable for extended periods of time and to prevent unwanted movement of the focusing rings during use (such as sagging or shifting due to swing movement). The device does not require any special or specific clothing items, such as a cap or the like. The device does not require any power source or any other accessories to properly use the device for both left and right eye primary aiming as well as both left and right handed users.

Golf is an extremely vision reliant sport. Applicant focused research around the opportunity to study the cone of vision and how that can relate to design opportunities. Applicant determined two types of dominance in the sport: (1) Type I: right eye, right hand, and foot dominance; and (2) Type II: any left tendency in the eye, hand, or foot. The device, according to embodiments of the present invention, can accommodate both types of dominance, using one simple system to interchange the focusing tool to either side of the head.

Figure 2A:
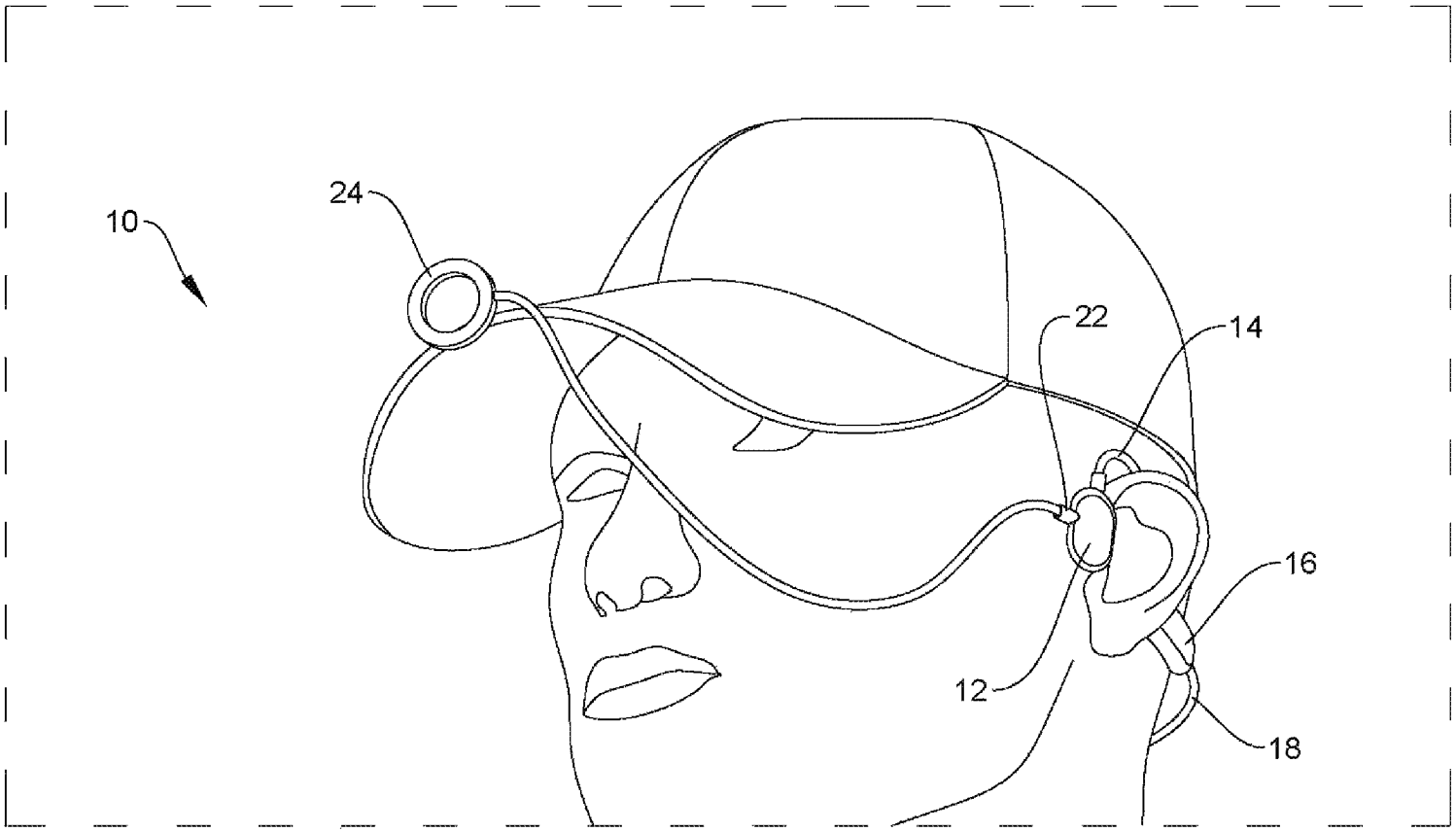
FIG. 2A illustrates the golf swing training device of FIG. 1 mounted on a person with the left-side arm attached.
Figure 2B:
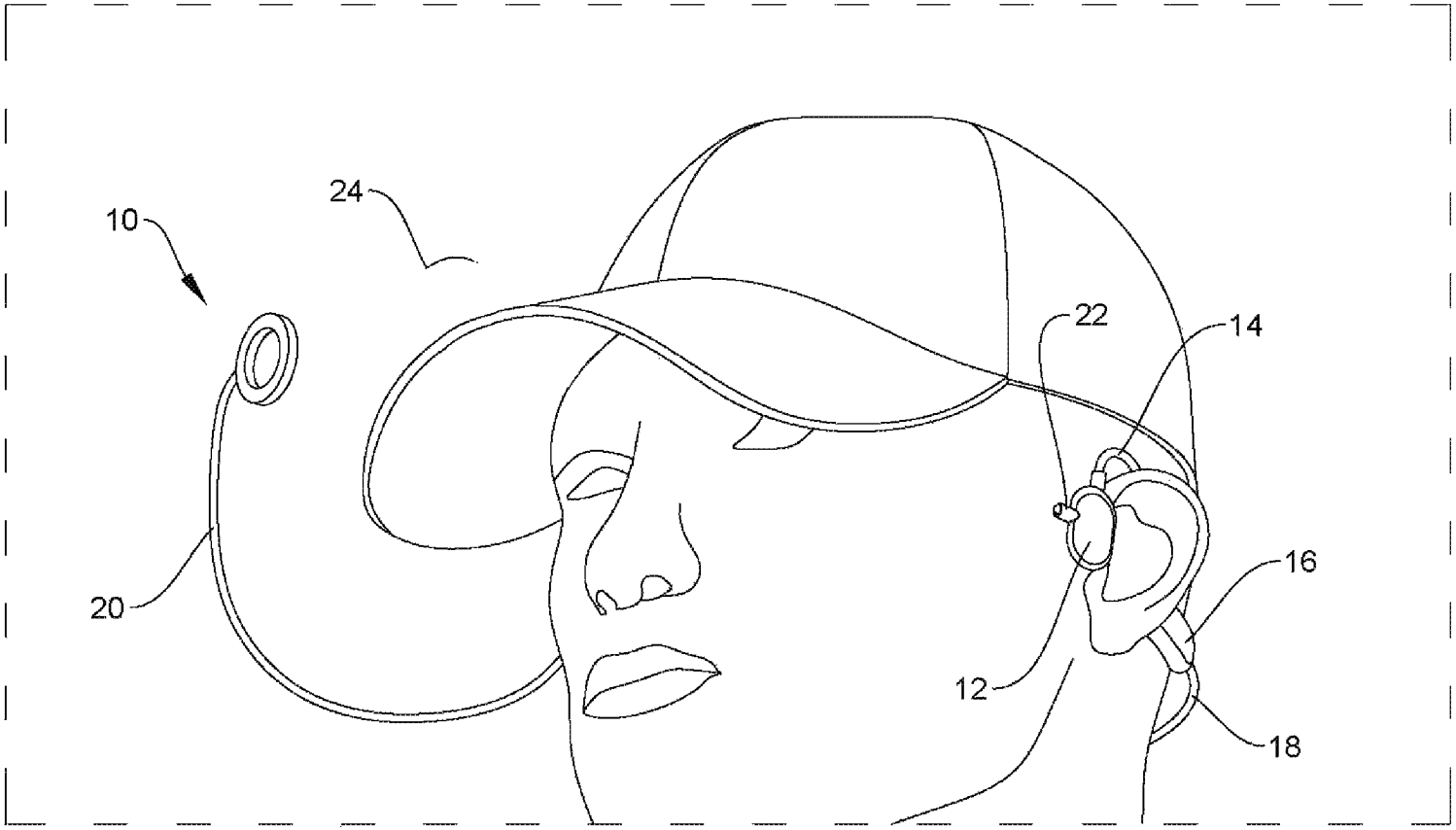
FIG. 2B illustrates the golf swing training device of FIG. 1 mounted on a person with the right-side arm attached.
Figure 3:
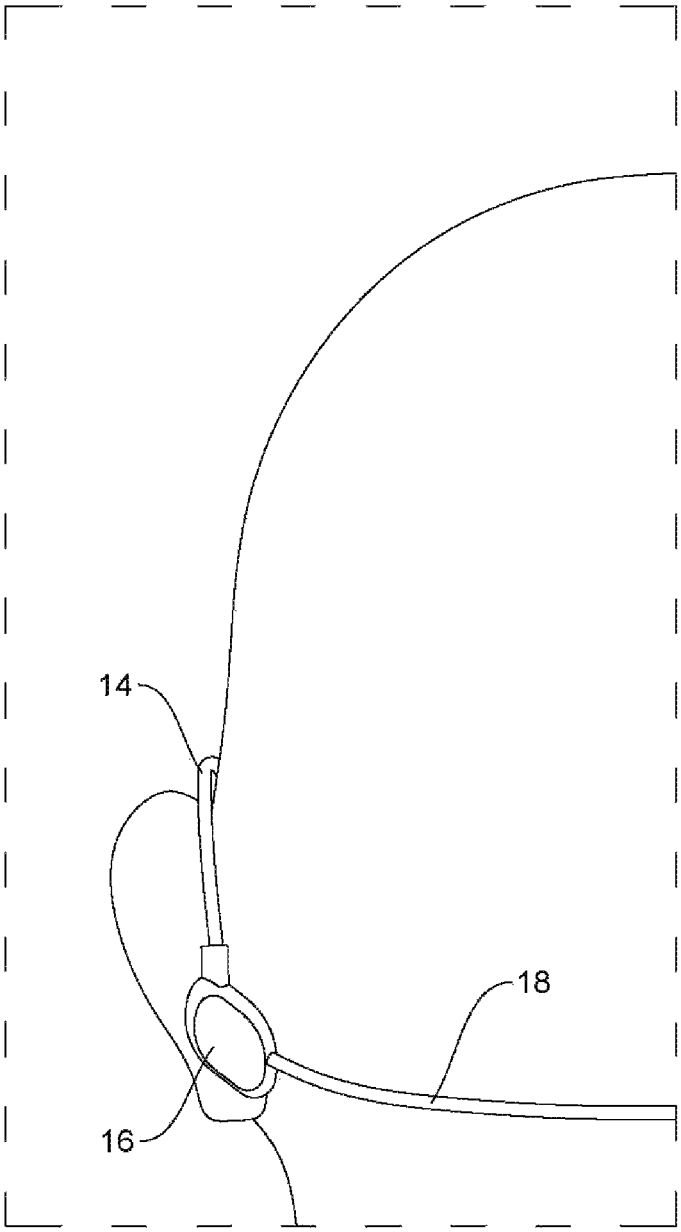
FIG. 3 illustrates a back view of the golf swing training device of FIG. 1 mounted on a person.
Figure 4:
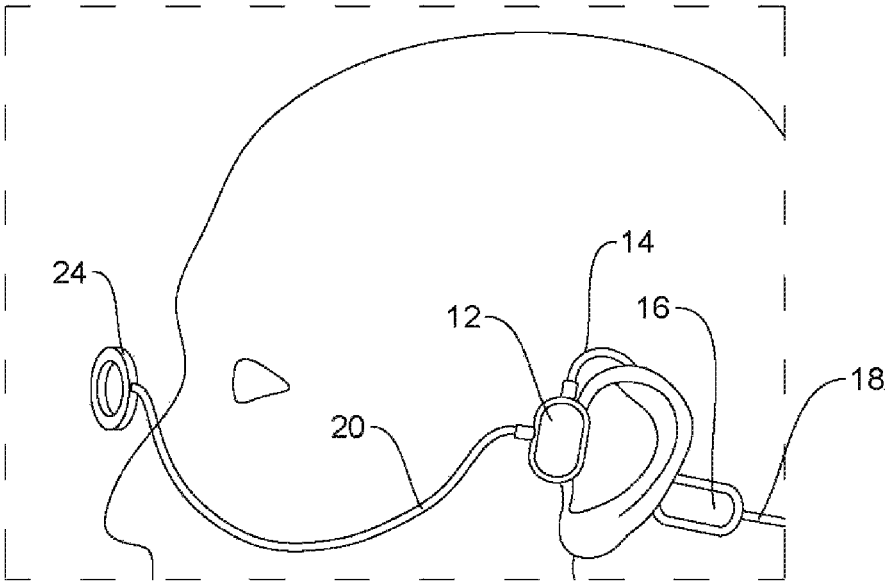
FIG. 4 illustrates a side view of the golf swing training device of FIG. 1 mounted on a person.
Figure 5:
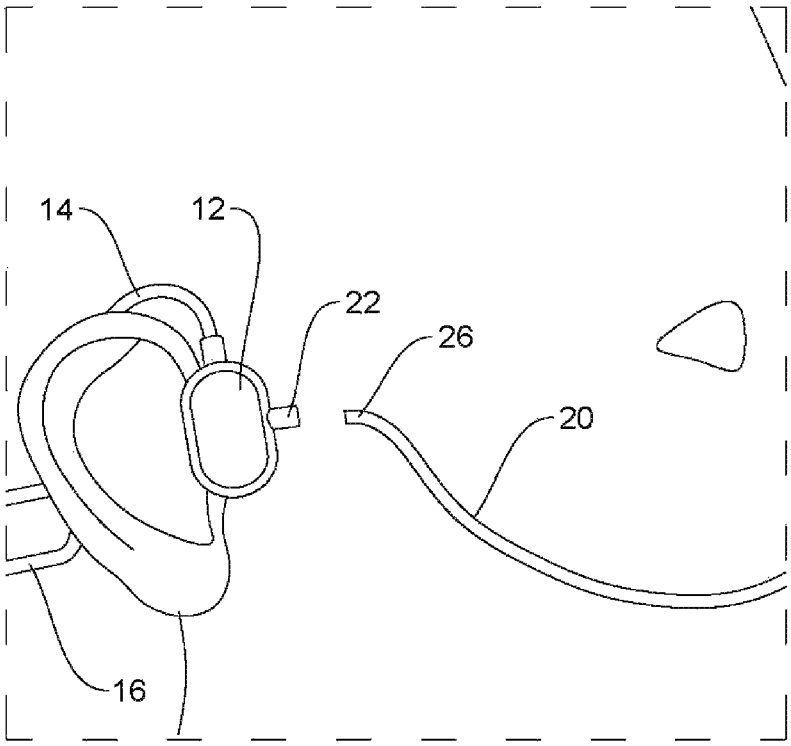
FIG. 5 illustrates a detailed view of the golf swing training device of FIG. 1 mounted on a person, showing how the flexible alignment portions can be removed from a front ear mount.

Referring now to FIGS. 1 through 5, a golf swing training device 10 (also referred to as training device 10, or simply device 10) can include focusing rings 24 connected by an at least partially flexible arm 20 to a mount system. In some embodiments, the focusing ring 24 may be removably attached to the arm 20.

The mount system can include two front ear pads 12, where each front ear pad 12 is positioned in front of each ear of the user. A connecting arm 14, also referred to an upper portion 14, can extend about the top of the ear of the user to attach to respective rear ear pads 16. Thus, each side of the device is similarly arranged, each side having one front ear pad 12 and one rear ear pad 16. Typically, the rear ear pad 16 is positioned below the front ear pad 12. A rear connector 18 can connect the two rear ear pads 16. The rear connector 18 is configured to wrap around the back of a user's head. The rear connector 18 may be resiliently expanded to position the device 10 on the user, where the resilient expansion may result in the front ear pads 12 and the rear ear pads 16 applying a pressure against the user's head. Such a pressure may be sufficient to keep the device in place without being uncomfortable to the user. The rear connector 18 may also provide a connection point along at least a portion of the back of the user's head.

A distal end 26 of the flexible arm 20 may be removably attached to one or both of the front ear pads 12 at a connector 22. Removing the flexible arms 20 may help the user fine tune the position of the focusing rings 24. The flexible arms 20 may be at least partially flexible such that portions of the flexible arms 20 may be flexed into a given position and the arms 20 can retain that desired position without resiliently returning to its original position. In some embodiments, some parts of the arms 20 may be fixed in shape, while other parts of the arms 20 may be flexibly positionable.

While two arms 20 are illustrated, typical use would be for the user to use one arm, depending on their strong eye, handedness, or the like. With the arms being removable, the device 10 can be used by golfers that are either left handed or right handed.

The arms 20 may or may not have the focusing ring 24 present at the end thereof. For example, the arm 20 could be used peripherally while focusing on the ball so the user would get instant feedback of how much and in what way the user's head moves during the backswing. Typically, the more still the golfer's head is on the back swing, the better the swing. To be more specific, by keeping the head still during the backswing, the middle and lower parts of the body are engaged to facilitate the completion of the backswing. Therefore, the more head movement there is on the backswing, the less engagement of the lower body. On the other hand, the focusing rings 24 may be particular useful in certain aspects. For example, during putting, the user may desire to use the focusing rings 24, where the ring may be applied to focus the user's vision to the golf ball and keep that focus during the putting swing.

In some embodiments, the focusing rings 24 may be open rings, as shown. In other embodiments, various elements may protrude into the interior of the focusing rings 24, such as a targeting sight, arrows, concentric circles, or the like.

Figure 6:
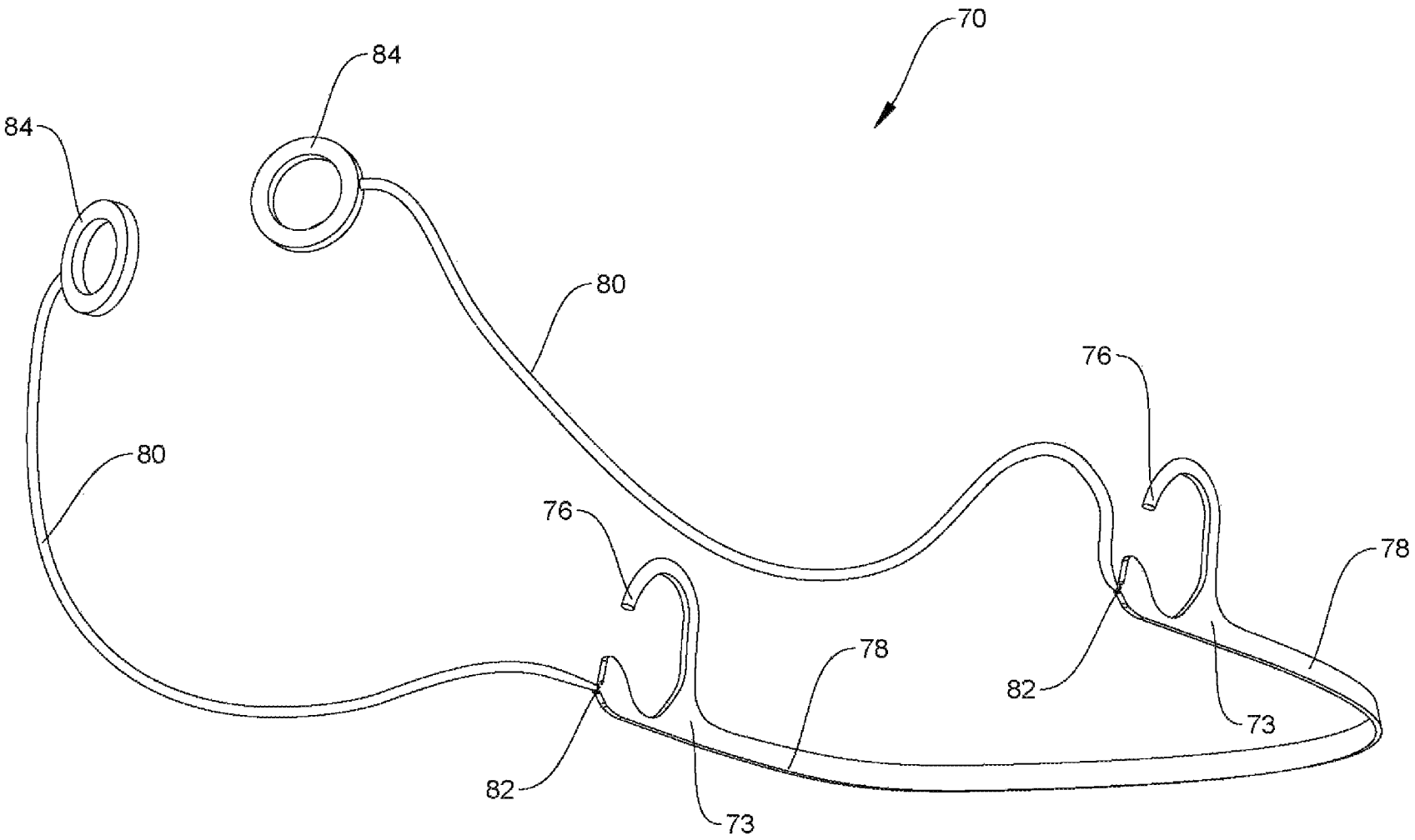
FIG. 6 illustrates a perspective view of a golf swing training device according to another exemplary embodiment of the present invention.
Figure 7A:
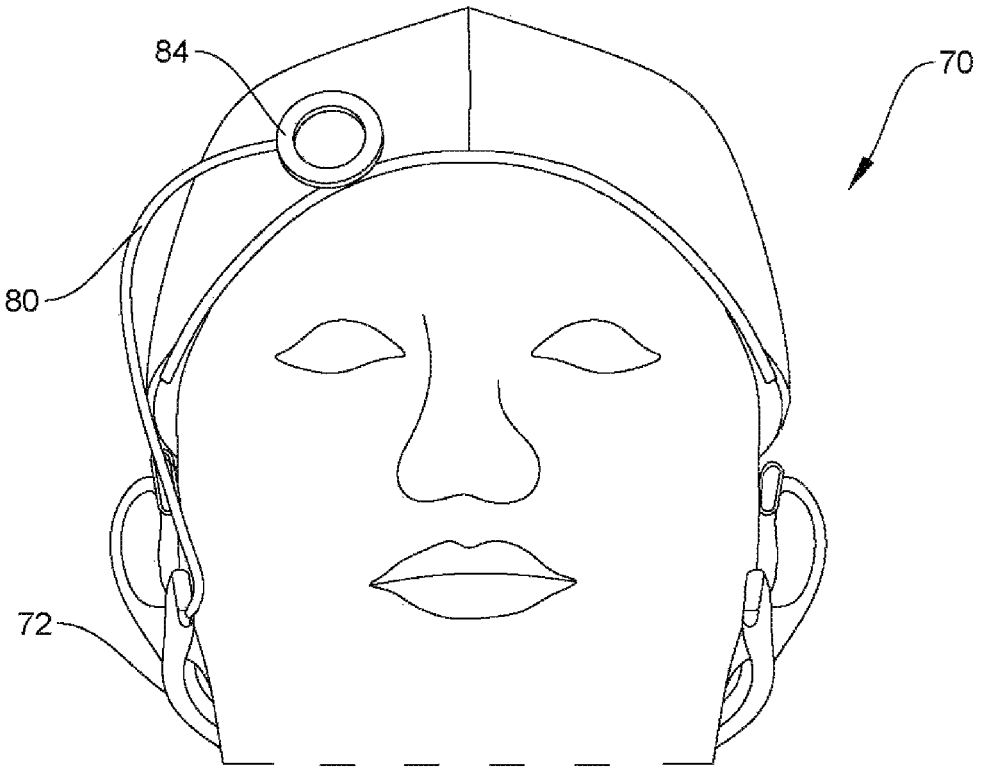
FIG. 7A illustrates a front view of the golf swing training device of FIG. 6, mounted on a user with the right-side arm attached.
Figure 7B:
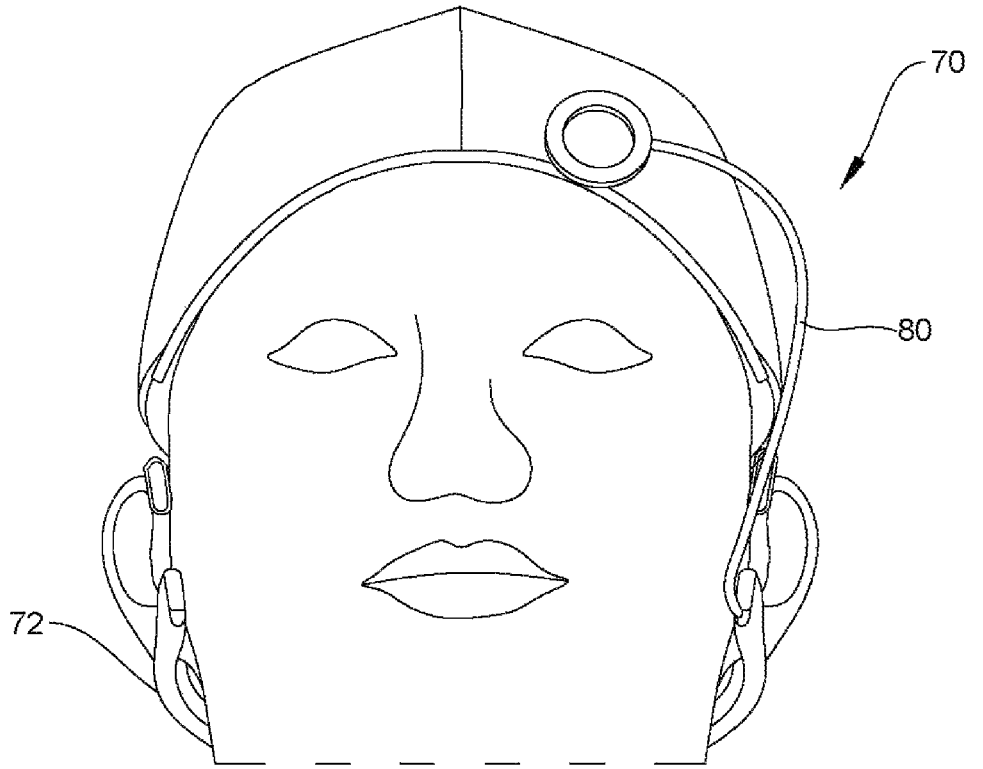
FIG. 7B illustrates a front view of the golf swing training device of FIG. 6, mounted on a user with the left-side arm attached.
Figure 8:
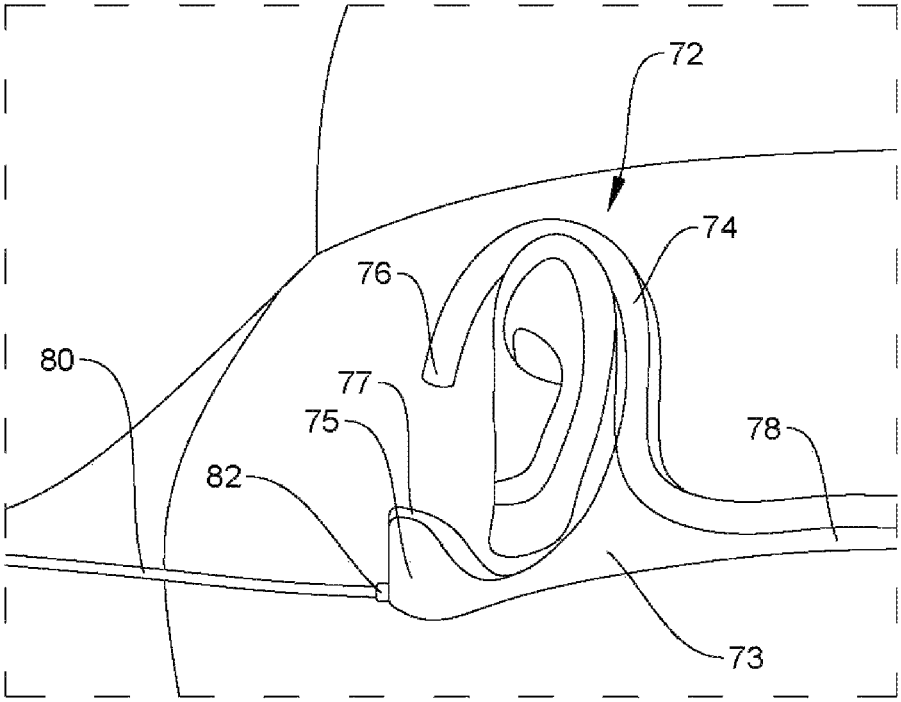
FIG. 8 illustrates a detailed side view of the golf swing training device of FIG. 6, mounted on a user.
Figure 9:
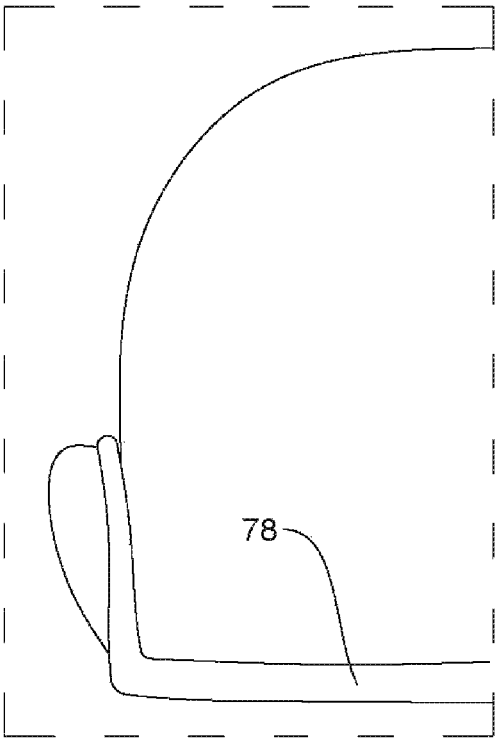
FIG. 9 illustrates a back view of the golf swing training device of FIG. 6, mounted on a user.
Figure 10:
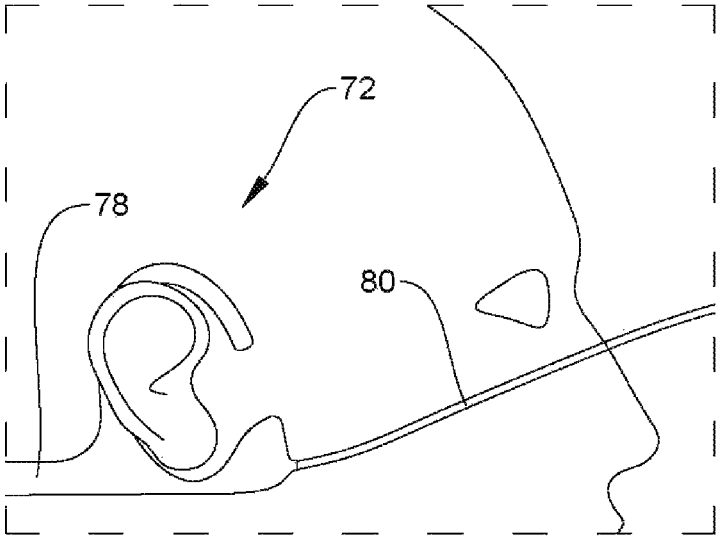
FIG. 10 illustrates a side view of the golf swing training device of FIG. 6, mounted on a user.
Figure 11:
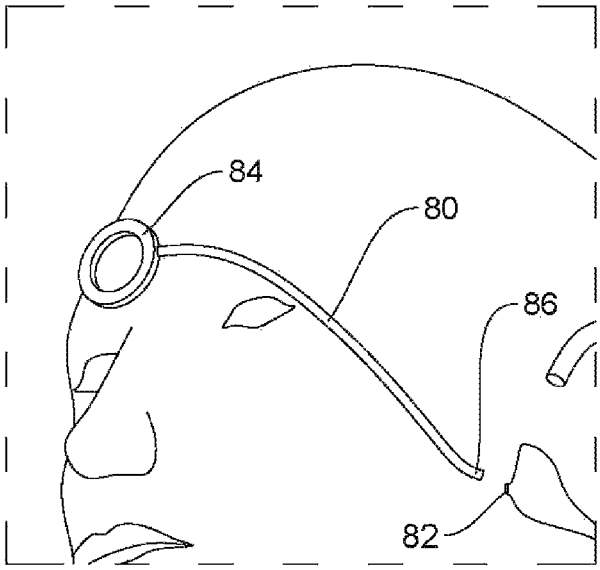
FIG. 11 illustrates a front detailed view of the golf swing training device of FIG. 6 mounted on a person, showing how the flexible alignment portions can be removed from an ear mount.

Referring now to FIGS. 6 through 11, a golf swing training device 70 (also referred to as a training device 70, or simply, device 70) can be configured similar to device 10, described above, except for (1) the structure of the side of head/ear attachments, and (2) the flexible arms 80 extend from a lower location as compared to the location in the device 70. Similar to the above embodiment, the flexible arms 80 are shown disposed on each side of the user, while, in use, only one such arm may be used for golf swing training. Also similar to the above description, the focusing ring 84 may be removed from the end of the arm 80 during use.

Thus, the device 70 can include focusing rings 84 connected by an at least partially flexible arm 80 to a mount system.

The mount system can include a C-shape ear mount 72 that extends from the front of the ear, around the top of the ear, the back of the ear and under the ear back to the front. An upper end 76, also referred to as upper portion 76, of the ear mount 72 can begin an arc shape to encircle the top of the ear. A behind the ear portion 74 can extend downward to a rear base member 73. The rear base member 73 may curve around the bottom of the ear to provide a front base member 75, where an upper end 77 of the front base member 75 is directed toward the upper end 75 of the ear mount 72. A connector 82 can be provided on the front side of the front base member 75. The connector 82 can provide for a removable attachment of a distal end 86 of the flexible arm 80.

A rear connector 78 can extend from a back side of each of the two rear base members 73. The rear connector 78 is configured to wrap around the back of a user's head. The rear connector 78 may be resiliently expanded to position the device 70 on the user, where the resilient expansion may result in the ear mounts 72 applying a pressure against the user's head. Such a pressure may be sufficient to keep the device in place without being uncomfortable to the user. The rear connector 78 may also provide a connection point along at least a portion of the back of the user's head.

A distal end 86 of the flexible arms 80 may be removably attached to the front base member 75 at a connector 82. Removing the flexible arms 80 may help the user fine tune the position of the focusing rings 24. The flexible arms 80 may be at least partially flexible such that portions of the flexible arms 80 may be flexed into a given position and the arms 80 can retain that desired position without resiliently returning to its original position. In some embodiments, some parts of the arms 80 may be fixed in shape, while other parts of the arms 80 may be flexibly positionable.

In some embodiments, the focusing rings 84 may be open rings, as shown. In other embodiments, various elements may protrude into the interior of the focusing rings 84, such as a targeting sight, arrows, concentric circles, or the like.

The rear connectors 18, 78 may be formed from a coated spring steel material, for example. Of course, other resiliently expandable materials may be used, such as plastic, rubber, or the like.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A golf swing training device comprising:

a rear connector operable to resiliently expand to extend partially about a user's head from behind one ear to behind an opposite ear, the resilient expansion providing a pressure drawing a first end of the rear connector toward a second, opposite end of the rear connector;

first and second ear mounts disposed on each of the first end and the second end of the rear connector, the first and second ear mounts each having an upper portion shaped to be disposed around an upper portion of a user's ear;

first and second rear ear pads respectively disposed at the first end and the second, opposite end of the rear connector, the first and second rear ear pads having a rear ear pad width greater than a width of the rear connector;

first and second front ear pads respectively disposed in front of the user's ear and attached to respective first and second rear ear pads, the first and second front ear pads having a front ear pad width greater than a width of the rear connector; and an arm extending from one of the first and second front ear pads ear mounts, the arm extending to a position forward of an entirety of the user's head, permitting a user to visualize a distal end of the arm, wherein the resilient expansion provides a pressure drawing both the first rear ear pad toward the second rear ear pad and drawing the first front ear pad toward the second front ear pad.

2. The golf swing training device of claim 1, further comprising a focusing ring disposed at the distal end of the arm.

3. The golf swing training device of claim 1, wherein the rear connector is formed in a C-shape.

4. The golf swing training device of claim 1, wherein the first and second rear ear pads have a planar contact surface operable to press against the user's head when the golf swing training device is disposed on the user.

5. The golf swing training device of claim 1, wherein the upper portion of the first and second ear mounts extends upward from respective first and second rear ear pads.

6. The golf swing training device of claim 1, wherein the upper portion extends upward from the first and second front ear pads.

7. The golf swing training device of claim 6, wherein the arm extends from a side of one of the first and second front ear pads.

8. The golf swing training device of claim 7, wherein the arm is removably attached to a side of one of the first and second front ear pads.

9. The golf swing training device of claim 6, wherein the first and second front ear pads are disposed along a plane higher than a plane defined by the first and second rear ear pads, higher being defined as closer to a top of the user's head when the golf swing training device is worn by the user.

10. The golf swing training device of claim 1, wherein the first and second front ear pads have a planar contact surface operable to press against the user's head when the golf swing training device is disposed on the user.

11. The golf swing training device of claim 1, wherein the first and second ear mounts include respective first and second lower arc shapes configured to extend about a lowermost portion of the user's ears when the golf swing training device is worn by the user.

12. The golf swing training device of claim 11, wherein the arm extends from a front portion of an end of one of the first and second lower arc shapes.

13. The golf swing training device of claim 12, wherein the arm is removably attached to the front portion of an end of one of the first and second lower arc shapes.

14. The golf swing training device of claim 12, wherein the upper portion of the first and second ear mounts form a continuous C-shape with the first and second lower arc shapes.

15. The golf swing training device of claim 14, wherein ends of the C-shape point toward each other.

16. The golf swing training device of claim 1, wherein the arm is at least partially bendable along one or more portions thereof to permit the user to bend the arm and the arm retains the bend selected by the user.

17. The golf swing training device of claim 1, wherein the rear connector and the first and second ear mounts provide at least three points of contact with the user when the golf swing training device is worn by the user.

18. A golf swing training device comprising:

a rear connector operable to resiliently expand to extend partially about a user's head from behind one ear to behind an opposite ear, the resilient expansion providing a pressure drawing a first end of the rear connector toward a second, opposite end of the rear connector;

first and second rear ear pads respectively disposed at the first end and the second, opposite end of the rear connector, the first and second rear ear pads having a rear ear pad width greater than a width of the rear connector;

first and second upper portions extending from respective first and second rear ear pads, the first and second upper portions being shaped to be disposed around an upper portion of a user's ear;

first and second front ear pads disposed in front of the user's ear at ends of respective first and second upper portions, the first and second front ear pads having a front ear pad width greater than a width of the rear connector; and an arm extending from one of the first and second front ear pads, the arm being at least partially bendable along one or more portions thereof to permit a user to bend the arm and the arm retains the bend selected by the user, the arm extending to a position forward of an entirety of the user's head, permitting the user to visualize a distal end of the arm, wherein the first and second rear ear pads have a planar contact surface operable to press against the user's head when the golf swing training device is disposed on a user;

the first and second front ear pads have a planar contact surface operable to press against the user's head when the golf swing training device is disposed on a user; and the rear connector and the first and second front and rear ear mounts provide at least three points of contact with a user when the golf swing training device is worn by a user.

19. A golf swing training device comprising:

a rear connector operable to resiliently expand to extend partially about a user's head from behind one ear to behind an opposite ear, the resilient expansion providing a pressure drawing a first end of the rear connector toward a second, opposite end of the rear connector;

first and second lower arc shapes configured to extend about a lowermost portion of the user's ears when the golf swing training device is worn by a user, a back side of the first and second lower arc shapes attached to respective first and second, opposite ends of the rear connector;

an arm extending from one of the first and second lower arc shapes, the arm being at least partially bendable along one or more portions thereof to permit a user to bend the arm and the arm retains the bend selected by the user, the arm extending to a position forward of an entirety of the user's head, permitting the user to visualize a distal end of the arm;

first and second upper arc shapes forming a continuous C-shape with respective first and second lower arc shapes, the first and second upper arc shapes configured to be disposed about an upper portion of a user's ear when the golf swing training device is disposed on a user, wherein the rear connector and the first and second front and rear ear mounts provide at least three points of contact with a user when the golf swing training device is worn by a user; and ends of the C-shape point toward each other, the ends providing first and second termini of the C-shape without attachment to any structure of the golf swing training device.

* * * * *